US009856706B2

(12) United States Patent
Strachan

(10) Patent No.: US 9,856,706 B2
(45) Date of Patent: Jan. 2, 2018

(54) METHODS AND SYSTEMS FOR PERFORMANCE OF SUBTERRANEAN OPERATIONS USING DUAL STRING PIPES

(75) Inventor: Michael John McLeod Strachan, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 435 days.

(21) Appl. No.: 14/403,298

(22) PCT Filed: Jun. 5, 2012

(86) PCT No.: PCT/US2012/040882

§ 371 (c)(1),
(2), (4) Date: Nov. 24, 2014

(87) PCT Pub. No.: WO2013/184100

PCT Pub. Date: Dec. 12, 2013

(65) Prior Publication Data

US 2015/0337610 A1 Nov. 26, 2015

(51) Int. Cl.

| | |
|---|---|
| ***E21B 21/10*** | (2006.01) |
| ***E21B 21/08*** | (2006.01) |
| ***E21B 17/18*** | (2006.01) |
| ***E21B 33/12*** | (2006.01) |
| ***E21B 21/12*** | (2006.01) |

(52) U.S. Cl.

CPC ..... *E21B 21/103* (2013.01); *E21B 17/18* (2013.01); *E21B 21/08* (2013.01); *E21B 21/12* (2013.01); *E21B 33/12* (2013.01)

(58) Field of Classification Search

CPC ..... E21B 17/18; E21B 21/08; E21B 21/103; E21B 21/12; E21B 33/12

See application file for complete search history.

(56) References Cited

U.S. PATENT DOCUMENTS

| | | | |
|---|---|---|---|
| 3,955,622 | A | 5/1976 | Jones |
| 4,434,849 | A | 3/1984 | Allen |
| 4,624,327 | A | 11/1986 | Reichman |
| 4,691,728 | A | 9/1987 | Mathison |
| 4,691,790 | A | 9/1987 | Reichman et al. |
| 7,093,662 | B2 | 8/2006 | DeBoer |

(Continued)

FOREIGN PATENT DOCUMENTS

| | | | |
|---|---|---|---|
| CN | 1500175 | A | 5/2004 |
| GB | 2365463 | B | 2/2002 |

(Continued)

OTHER PUBLICATIONS

Official Action issued in related Russian application No. 2014152035, dated Feb. 11, 2016 (14 pages with translation).

(Continued)

*Primary Examiner* — Caroline N Butcher

(74) *Attorney, Agent, or Firm* — Alan Bryson; Baker Botts L.L.P.

(57) ABSTRACT

Methods and systems for delivery and retrieval of fluids to and from a downhole location are disclosed. A dual string pipe (202) is provided which comprises an outer pipe (206), an inner pipe (204) positioned within the outer pipe, and a bottom hole assembly (210) fluidically coupled to the outer pipe and the inner pipe. A diverter sub (208) is coupled to the inner pipe and is selectively operable in a normal drilling mode and a high flow mode. In the normal drilling mode a fluid is directed downhole through the inner pipe and in the high flow mode a return fluid is directed uphole through the inner pipe.

16 Claims, 3 Drawing Sheets

(56) References Cited

U.S. PATENT DOCUMENTS

| | | | | |
|---|---|---|---|---|
| 7,096,976 | B2 | 8/2006 | Paluch et al. | |
| 7,134,514 | B2 | 11/2006 | Riel et al. | |
| 7,152,700 | B2 | 12/2006 | Church et al. | |
| 7,283,061 | B1 | 10/2007 | Snider et al. | |
| 2003/0141111 | A1* | 7/2003 | Pia | E21B 17/20 175/57 |
| 2004/0256157 | A1* | 12/2004 | Tessari | E21B 7/20 175/57 |
| 2005/0274547 | A1 | 12/2005 | Fincher et al. | |
| 2008/0264690 | A1* | 10/2008 | Khan | E21B 21/00 175/25 |
| 2013/0087389 | A1* | 4/2013 | Hole | E21B 17/18 175/65 |

FOREIGN PATENT DOCUMENTS

| | | | |
|---|---|---|---|
| GB | 2454895 | A | 5/2009 |
| RU | 2082866 | C1 | 6/1997 |
| SU | 1583584 | A1 | 8/1990 |
| WO | 91/17339 | A1 | 11/1991 |
| WO | 02/10549 | A2 | 2/2002 |
| WO | WO0210549 | A2 | 7/2002 |
| WO | 02/081856 | A1 | 10/2002 |
| WO | 03/062590 | A1 | 7/2003 |
| WO | WO03062590 | A1 | 7/2003 |

OTHER PUBLICATIONS

Ivachev L.M. "Clearing and Tamponing of Geologic Wells", Moscow, Nedra, 1989, p. 12, 12, fig. 1.2 (5 pages, translated).

Office Action issued in related Chinese Application No. 201280073709.3, dated Jun. 1, 2016 (11 pages).

Reelwell Drilling Method (2011), www.reelwell.com, 12 pages.

International Search Report and Written Opinion issued in related PCT Application No. PCT/US2012/040882 dated Feb. 14, 2013, 16 pages.

* cited by examiner

METHODS AND SYSTEMS FOR PERFORMANCE OF SUBTERRANEAN OPERATIONS USING DUAL STRING PIPES

CROSS-REFERENCE TO RELATED APPLICATION

This application is a U.S. National Stage Application of International Application No. PCT/US2012/040882 filed Jun. 5, 2012, which is hereby incorporated by reference in its entirety.

BACKGROUND

Hydrocarbons, such as oil and gas, are commonly obtained from subterranean formations. The development of subterranean operations and the processes involved in removing hydrocarbons from a subterranean formation are complex. Typically, subterranean operations involve a number of different steps such as, for example, drilling the wellbore at a desired well site, treating the wellbore to optimize production of hydrocarbons, and performing the necessary steps to produce and process the hydrocarbons from the subterranean formation.

In order to understand the formation testing process, it is important to understand how hydrocarbons are stored in subterranean formations. Typically, hydrocarbons are stored in small holes, or pores, within the subterranean formation. The ability of a formation to allow hydrocarbons to flow between pores and consequently, into a wellbore, is referred to as permeability. Additionally, hydrocarbons contained within a formation are typically stored under pressure. It is therefore beneficial to determine the magnitude of that pressure in order to safely and efficiently produce from the well.

Drilling operations play an important role when developing oil, gas or water wells or when mining for minerals and the like. A drilling fluid ("mud") is typically injected into a wellbore when performing drilling operations. The mud may be water, a water-based mud or an oil-based mud. During the drilling operations, a drill bit passes through various layers of earth strata as it descends to a desired depth. Drilling fluids are commonly employed during the drilling operations and perform several important functions including, but not limited to, removing the cuttings from the well to the surface, controlling formation pressures, sealing permeable formations, minimizing formation damage, and cooling and lubricating the drill bit.

One of the methods used during drilling operations is the Reelwell Drilling Method ("RDM") developed by Reelwell of Stavanger, Norway. In accordance with RDM, as shown in FIG. 1, a dual string drill pipe 102 comprising an inner pipe 104 and an outer pipe 106 is inserted into a wellbore 108 that passes through a formation of interest 110. The drilling fluid may be directed downhole through the annular channel 112 of the drill string and exits the dual string drill pipe 102 through a Bottom Hole Assembly ("BHA") 114. Return ports 116 are provided above the standard BHA 114. The BHA 114 may include a number of components such as, for example, the drill bit, the bit sub, a mud motor, stabilizers, drill collar, heavy weight drillpipe, jarring devices and/or cross overs for various threadforms. The returning drilling fluid (which contains the cuttings) is directed into the return ports 116 and flows through the inner pipe 104 back to the surface. The return ports 116 of the RDM may be used to clean the wellbore when performing drilling operations by facilitating removal of drill cuttings through the inner pipe 104. Additionally, a piston 118 may be coupled to the outer pipe 106 to provide weight on the drill bit. The piston 118 may push the dual string drill pipe 102 forward by putting hydraulic pressure on the drill bit in the BHA 114. Additionally, the piston 118 may act as a barrier preventing the loss of annular well fluids.

However, the typical RDM methods has a number of drawbacks. First, only a portion of the dual string drill pipe 102 may be utilized for directing the drilling fluid downhole. Specifically, the drilling fluid may be directed downhole through the annular channel 112 between the inner pipe 104 and the outer pipe 106 because the inner pipe is utilized for returning the drilling fluid to the surface. This limits the rate at which drilling fluid can be delivered to the drilling location. The limitation on the rate of delivery of drilling fluids may adversely impact the drilling operations. Moreover, hydraulic motors relying on hydraulic pressure are often used when performing drilling operations. Therefore, the limited rate of delivery of drilling fluids results in less hydraulic pressure being available downhole for a hydraulic motor. Moreover, the piston 118 that places weight on the drill bit 114 is fixed so when the section of liner or casing it is in is reached, the drilling has to stop and the piston pulled to reposition it. Further, typically, the piston 118 can not be easily removed or collapsed to facilitate extra flow area for cementing operations. Finally, in order to perform drilling operations using the RDM, sections of the inner pipe 104 and the outer pipe 106 need to be laid out on the surface and cut in predetermined lengths to form matching pairs of inner and outer pipes that can form segments of the drillstring. This process adds to the cost of performing the drilling operations and consumes valuable time.

Moreover, cementing operations are another part of performing subterranean operations. For instance, it may be desirable to isolate section of the wellbore by forming one or more cement plugs therebetween. During typical cementing operations, a cement mix is prepared at the surface and pumped downhole to a desired location. When preparing the cement mix, it is important to carry out accurate calculations to determine the setting time and pump the mix downhole accordingly so that the cement mix cures at the perfect time at the particular location of interest. Specifically, if the cement mix cures too early or too late it may not form the cement plug at its intended location.

Figure 1:
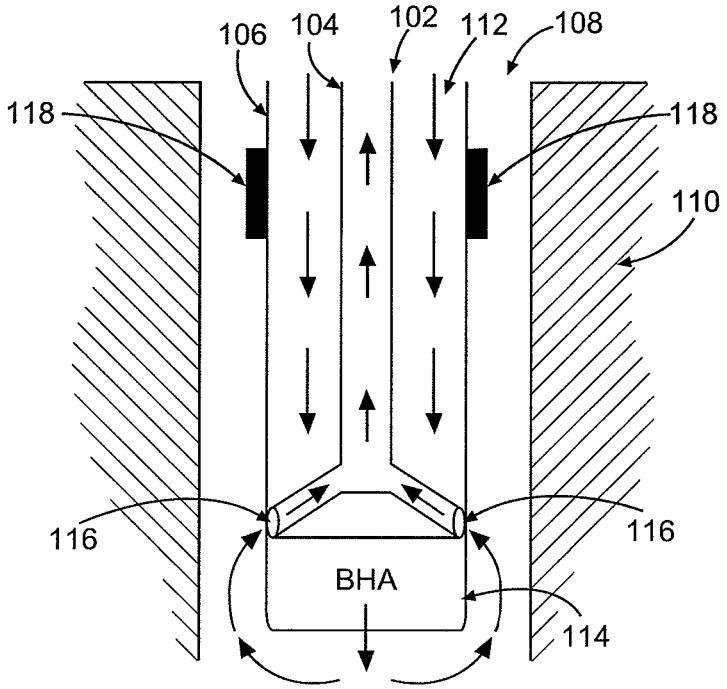
FIG. 1 is a dual string drill pipe mechanism in accordance with the prior art.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

The terms "couple" or "couples" as used herein are intended to mean either an indirect or direct connection. Thus, if a first device couples to a second device, that connection may be through a direct connection, or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. Finally, the term "fluidically coupled" as used herein is intended to mean that there is either a direct or an indirect fluid flow path between two components.

The term "uphole" as used herein means along the drillstring or the wellbore hole from the distal end towards the surface, and "downhole" as used herein means along the drillstring or the wellbore hole from the surface towards the distal end.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline, MWD and LWD operations.

The present application is directed to improving efficiency of subterranean operations and more specifically, to a method and system for improving delivery and retrieval of fluids to and from a downhole location.

Figure 2:
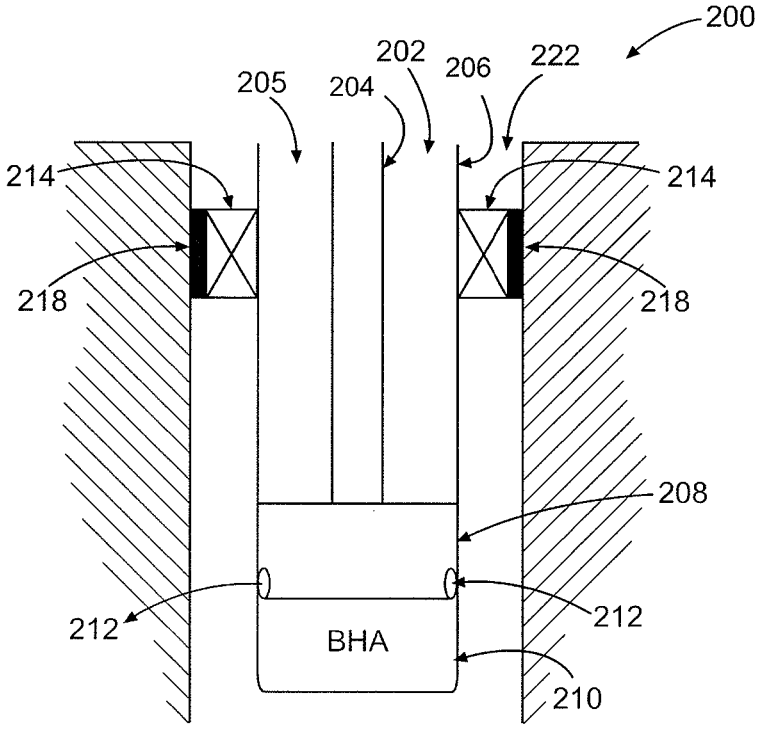
FIG. 2 is an improved dual string pipe mechanism in accordance with an embodiment of the present disclosure.

Turning now to FIG. 2, an improved dual string drilling system in accordance with an embodiment of the present disclosure is denoted generally with reference numeral 200. The improved dual string drilling system 200 includes an inner pipe 204 and an outer pipe 206. A diverter sub 208 may be coupled to the dual string pipe 202. The fluid flowing through the diverter sub 208 is directed to the BHA 210 and the return fluid is returned to return ports 212 of the diverter sub 208. The diverter sub 208 permits selectively directing fluids downhole or returning fluids uphole using the inner pipe 204. The operation of the diverter sub 208 will now be discussed in more detail in conjunction with FIGS. 3A and 3B.

Figure 3A:
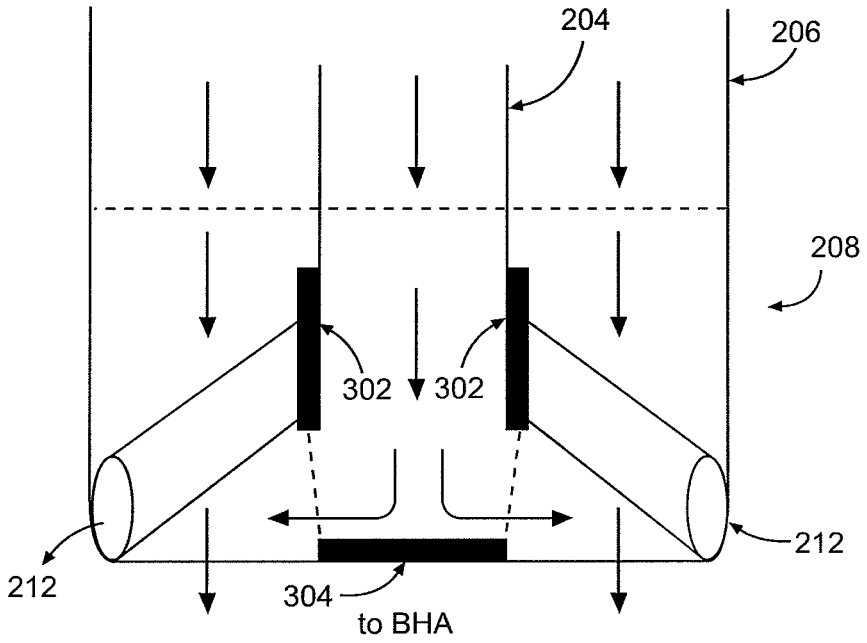
FIG. 3A is a closeup view of the diverter sub of the improved dual string pipe mechanism configured to be in the closed position.

FIG. 3A depicts an exemplary configuration of the diverter sub 208 in a closed position. In the closed position, the diverter sub 208 facilitates delivery of drilling fluids to the BHA 210 through both an annulus 205 between the inner pipe 204 and the outer pipe 206 and the inner pipe 204 itself. As shown in FIG. 3A, the diverter sub comprises a pair of return port valves 302 that are operable to open and close the return ports 212. Additionally, the diverter sub may comprise an inner pipe valve 304 that is configured to open and close an outlet at the end of the inner pipe 204 proximate to the BHA 210. As shown in FIG. 3, with the diverter sub 208 in the closed position as shown in FIG. 3A, the return ports 212 are closed, preventing return fluids from flowing into the inner pipe 204. In contrast, when the diverter sub 208 is in the closed position, the inner pipe valve 304 is positioned to permit delivery of fluids flowing downhole through the inner pipe 204 to the BHA 210.

Figure 3B:
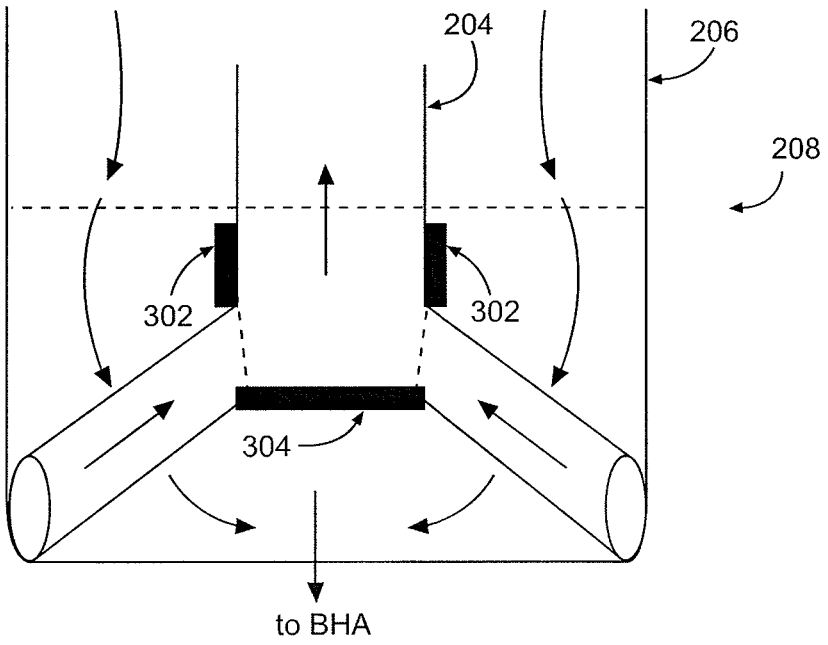
FIG. 3B is a closeup view of the diverter sub of the improved dual string pipe mechanism configured to be in the open position.

FIG. 3B depicts the diverter sub 208 in an open position. In the open position, the return port valves 302 are opened permitting fluid flow through the return ports 212 into the inner pipe 204. At the same time, the inner pipe valve 304 closes off the bottom of the inner pipe 204, preventing fluid flow from the inner pipe 204 to the BHA 210. As would be appreciated by those of ordinary skill in the art, with the benefit of this disclosure, the valves 302, 304 may be any suitable valves, including, but not limited to, a flapper valve, plug (piston) valve, gate valve, pinch valve, diaphragm valve, rotary valve such as a ball valve or butterfly valve. In certain preferred embodiments, a piston or plug valve may be the best suited valve to seal with the given geometries. Moreover, the valves 302, 304 may be communicatively coupled to an information handling system (not shown) and may be controlled from the surface to selectively place the diverter sub 208 in the open or the closed position. Specifically, computer-readable instructions may be stored in a computer readable medium and be used by the information handling system to control the diverter sub 208.

Returning now to FIG. 2, the improved dual string drilling system 200 may be utilized in two different modes of operation. In the first mode, referred to as the normal drilling mode, the diverter sub 208 is in the closed position and a fluid may be directed downhole through the inner pipe 204 from the surface to a desired location downhole along the wellbore axis. Both the inner pipe 204 and the annulus 205 between the inner pipe 204 and the outer pipe 206 are utilized to provide a path for fluid flow from the surface to the BHA 210. In the second mode, referred to as the high flow mode, the diverter sub 208 is in the open position. Accordingly, the downward flow of the drilling fluid continues through the annulus 205 between the inner pipe 204 and the outer pipe 206 to the BHA 210. With the diverter sub 208 in the open position, the return ports 212 are fluidically coupled to the inner pipe 204. Accordingly, the return fluid together with cuttings and other materials removed from the downhole location may be directed to the return ports 212 and returned to surface through the inner pipe 204. In certain embodiments, the diverter sub 208 may be cycled multiple times between its open and closed positions when performing a subterranean operation to provide the high flow mode on demand. As would be appreciated by those of ordinary skill in the art, with the benefit of this disclosure, the high flow mode may be used in a clean out mode to perform clean out operations or in a cementing mode to perform cementing operations.

In certain embodiments, the improved dual string drilling system 200 may include one or more packers 214 positioned at different axial positions along the its length. In one embodiment, the packers 214 may be inflatable packers. The packers 214 may bridge the annulus 222 between a casing 216 (or the wellbore if the well is not cased) and the outer pipe 206. As shown in FIG. 2, the outer pipe 204 may be positioned within the casing 216. In one embodiment, the packers 214 may include a seal element 218 that does not rotate with the casing 216 but allows the dual string pipe 202 to rotate freely. The activation/deactivation of the packers 214 may be powered and controlled by electrical commands from the surface which may be directed downhole using a wired or wireless communication network. In certain embodiments, an information handling system may be communicatively coupled to the packers 214 and control operations thereof.

The packers 214 may serve a number of functions. For instance, the packers may be used to close the annulus 222 between the casing 216 (or the wellbore wall if not cased) and the outer pipe 206 to prevent return of fluids to the surface. Moreover, in certain embodiments, hydraulic pressure may be applied to an upper side of the packers 214 in order to exert a downward pressure on the BHA 210 and the drill bit. Additionally, in certain embodiments, the packers 214 may be utilized to inject fluids into the fluid flow stream provided by the dual string drilling system 200.

Figure 4:
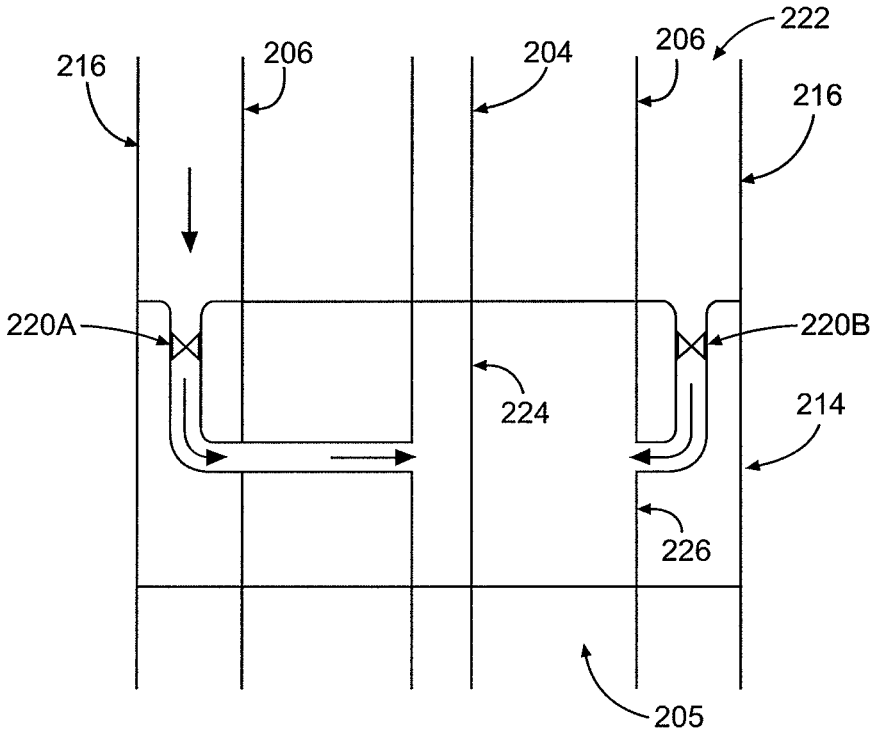
FIG. 4 is a closeup view of the packer of the improved dual string pipe mechanism in accordance with an embodiment of the present disclosure.

FIG. 4 depicts a cross sectional view of a packer 214 in accordance with one exemplary embodiment of the present disclosure. In one embodiment, the packer 214 may be a subassembly that is inserted between two sections of the dual string pipe 202. Accordingly, the packer 214 may include a packer inner pipe 224 and a packer outer pipe 226 that are fluidically coupled to the inner pipe 204 and the outer pipe 206, respectively. The packer 214 may further include an inner pipe valve 220A and an outer pipe valve 220B that as discussed in more detail below, are operable to fluidically couple the annulus 222 with the inner pipe 204 or the annulus 205. As would be appreciated by those of ordinary skill in the art, with the benefit of this disclosure, the present invention is not limited to the specific arrangement of valves depicted in FIG. 4. For instance, more valves may be used to achieve different specific fluid flow mechanisms without departing from the scope of the present disclosure.

The inner pipe valve 220A may control fluid flow from the annulus 222 between the outer pipe 206 and the casing 216 (or the wellbore if not cased) into the packer 214 and into the inner pipe 204. In contrast, the outer pipe valve 220B may control fluid flow from the annulus 222 into the packer 214 and into the annulus 205 between the inner pipe 204 and the outer pipe 206. As would be appreciated by those of ordinary skill in the art, with the benefit of this disclosure, any suitable valves may be utilized in much the same way as the diverter valve, such as, for example a flapper valve, plug (piston) valve, gate valve, pinch valve, diaphragm valve, rotary valve such as a ball valve or butterfly valve. In certain preferred embodiments, a piston or plug valve is optimal as it can be easily sealed with the given geometries.

In the normal drilling mode or the high flow mode, the valves 220A and 220B may be closed and no fluid flows from the annulus 222 into either the inner pipe 204 or the annulus 205 between the inner pipe 204 and the outer pipe 206. Accordingly, because the packer inner pipe 224 and the packer outer pipe 226 are in fluid communication with the inner pipe 204 and the outer pipe 206, fluid flow through the dual string pipe 202 continues in the same manner discussed above in conjunction with FIGS. 1-3. However, the valves 220A, 220B may be selectively opened and closed to inject fluids into the fluid stream flowing through the inner pipe 204 and/or the annulus 205.

In certain embodiments, it may be desirable to inject a fluid into the downhole fluid flow through the annulus 205 when in the normal drilling mode or in the high flow mode. The outer pipe valve 220B may be opened and a fluid that is to be injected into the stream flowing downhole through the annulus 205 may be directed to the annulus 205 through the annulus 222 and the packer 214. Accordingly, fluids may be injected into the downward flow in the annulus 205 from the surface at a controlled rate. Similarly, it may be desirable to inject a fluid into the inner pipe 204 when in the normal drilling mode with the fluid flowing downhole from the surface. Accordingly, the inner pipe valve 220A may be opened and the fluid may be directed into the inner pipe 204 through the annulus 222 and the packer 214.

Moreover, in certain embodiments it may be desirable to inject a fluid into the return fluid flow through the inner pipe 204 in the high flow mode. For instance, it may be desirable to inject air, Nitrogen, or other appropriate fluids into the upward fluid flow through the inner pipe 204 during the high flow mode in order to increase the annular velocity of the return fluid and improve the hole cleaning operations. Accordingly, air, Nitrogen, or other appropriate fluids may be directed to the fluid stream in the inner pipe through the annulus 222 and the packer 214 by opening the inner pipe valve 220A.

Returning now to FIG. 2, the improved dual string pipe 202 of the present disclosure may be used to perform cementing operations by providing a quick setting isolation system. In accordance with an embodiment of the present disclosure a two part cement mix may be prepared at the surface whereby the cement cures once the two parts come in contact with one to another. In one embodiment, the two part cement mix may comprise an epoxy component and a hardner component. An improved dual string pipe 202 may be positioned in the wellbore with the outlet of the dual string pipe 202 located proximate to a location where the cement plug is to be formed. A first part of the two part cement mix may be directed downhole through the inner pipe 204 and a second part may be directed downhole through the annulus 205 between the inner pipe 204 and the outer pipe 206. Once the first part and the second part of the two part cement mix exit the outlet of the dual string pipe 202 at the desired location and come in contact they will create a cement plug. Accordingly, using the dual string pipe 202 to perform cementing operations may obviate the need for utilizing resources to calculate the cement setting time in detail and implement the pumping operations in a manner to ensure the cement mixture is positioned at the right position downhole at its setting time.

Figure 5:
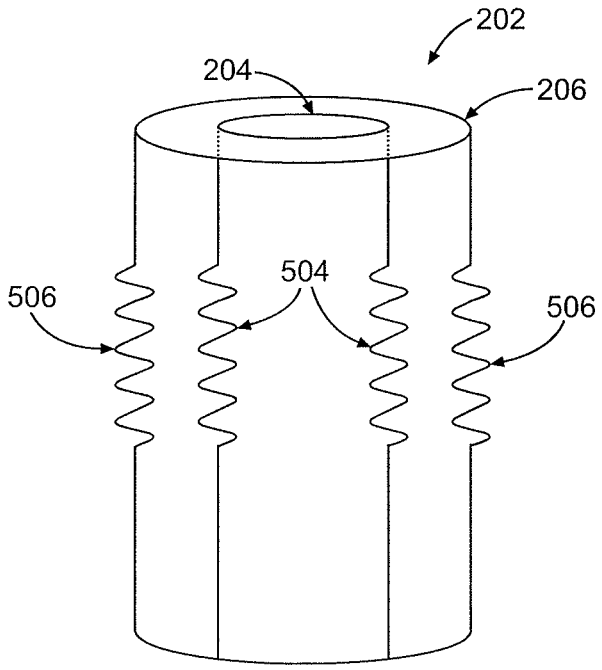
FIG. 5 depicts an improved dual string pipe segment in accordance with an embodiment of the present disclosure.

In certain embodiments, as discussed above, the dual string pipe 202 may comprise two or more segments of pipes with one or more subassemblies or components placed therebetween. As shown in FIG. 5, in accordance with an embodiment of the present disclosure, the inner pipe 204 and the outer pipe 206 of the dual pipe string 202 may each comprise a corrugated section 504 and 506, respectively. The corrugated sections 504, 506 permit the inner pipe 204 and the outer pipe 206 to be extended and/or retracted to a desired length. Accordingly, because the inner pipe 204 and the outer pipe 206 now have a variable length, there is no need to cut sections of inner pipe 204 to match the length of sections of the outer pipe 206 when assembling the different drill pipe segments. The uses of inner pipe 204 and outer pipe 206 with corrugated sections that need not be cut helps maintain the integrity of top and bottom connections of the different drill pipe segments.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A dual string pipe comprising:
- an outer pipe;
- an inner pipe positioned within the outer pipe;
- a bottom hole assembly fluidically coupled to the outer pipe and the inner pipe;
- a diverter sub coupled to the inner pipe,
  - wherein the diverter sub is selectively operable in a normal drilling mode and a high flow mode,
  - wherein in the normal drilling mode the diverter sub is in a closed position, and
  - wherein in the high flow mode the diverter sub is in an open position;
- a casing, wherein the outer pipe is positioned within the casing;
- a first annulus, wherein the first annulus is formed between the inner pipe and the outer pipe, wherein in the normal drilling mode a fluid from a surface is directed downhole through the inner pipe and the first annulus, and wherein in the high flow mode the fluid is directed downhole through the first annulus and a return fluid is directed uphole through the inner pipe;
- a second annulus, wherein the second annulus is formed between the outer pipe and the casing; and
- a packer coupled to the outer pipe, wherein the packer extends into the second annulus, wherein the packer comprises one or more valves, wherein the one or more valves are operable to fluidically couple the second annulus with at least one of the first annulus and the inner pipe, and wherein an additional fluid is directed into the first annulus through the second annulus and the packer.

2. The dual string pipe of claim 1, wherein the diverter sub comprises a return port, wherein in the high flow mode the return fluid flows into the inner pipe through the return port.

3. The dual string pipe of claim 2, wherein the diverter sub comprises a return port valve, wherein the return port valve selectively opens and closes the return port.

4. The dual string pipe of claim 3, wherein the diverter sub comprises an inner pipe valve, wherein the inner pipe valve selectively opens and closes an outlet of the inner pipe.

5. The dual string pipe of claim 4, wherein in the normal drilling mode the return port valve closes the return port and the inner pipe valve opens the outlet of the inner pipe.

6. The dual string pipe of claim 4, wherein in the high flow mode the return port valve opens the return port and the inner pipe valve closes the outlet of the inner pipe.

7. The dual string pipe of claim 1, further comprising a packer coupled to at least one of the inner pipe and the outer pipe.

8. The dual string pipe of claim 1, wherein at least one of the inner pipe and the outer pipe is corrugated.

9. The dual string pipe of claim 1, wherein the high flow mode is selected from a group consisting of a clean out mode and a cementing mode.

10. A method of selectively directing fluids between a surface location and a downhole location comprising:
- placing a dual string pipe in a wellbore,
  - wherein the dual string pipe comprises an inner pipe located within an outer pipe;
- coupling a diverter sub to the dual string pipe,
  - wherein the diverter sub comprises one or more valves, and wherein the diverter sub is selectively operable in a normal drilling mode and a high flow mode;

positioning an outer pipe within a casing;

wherein a first annulus is formed between the inner pipe and the outer pipe;

wherein a second annulus is formed between the outer pipe and the casing; and wherein a packer is coupled to the outer pipe and the packer extends into the second annulus, wherein the packer comprises one or more valves, wherein the one or more valves are operable to fluidically couple the second annulus with at least one of the first annulus and the inner pipe;

selectively controlling the diverter sub when in a closed position to direct a first fluid from the surface location to the downhole location through the inner pipe and the first annulus and when in an open position to direct a second fluid from the downhole location to the surface location through the inner pipe and the first fluid downhole through the first annulus; and injecting a third fluid into the first fluid by directing the third fluid through the second annulus and the packer.

11. The method of claim 10, wherein the diverter sub comprises a return port, wherein in the high flow mode the return fluid flows into the inner pipe through the return port.

12. The method of claim 10, wherein the diverter sub comprises a return port valve, wherein the return port valve selectively opens and closes the return port.

13. The method of claim 10, wherein the diverter sub comprises an inner pipe valve, wherein the inner pipe valve selectively opens and closes an outlet of the inner pipe.

14. The method of claim 10, wherein in the normal drilling mode the return port valve closes the return port and the inner pipe valve opens the outlet of the inner pipe.

15. The method of claim 10, wherein in the high flow mode the return port valve opens the return port and the inner pipe valve closes the outlet of the inner pipe.

16. The method of claim 10, wherein at least one of the inner pipe and the outer pipe is corrugated.

* * * * *